US009909396B2

(12) United States Patent
Frosell et al.

(10) Patent No.: US 9,909,396 B2
(45) **Date of Patent: *Mar. 6, 2018**

(54) EROSION REDUCTION IN SUBTERRANEAN WELLS

(71) Applicant: HALLIBURTON ENERGY SERVICES, INC., Houston, TX (US)

(72) Inventors: Thomas J. Frosell, Irving, TX (US); Emile E. Sevadjian, Carrollton, TX (US); Michael L. Fripp, Carrollton, TX (US); Ralph H. Echols, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/332,179

(22) Filed: Oct. 24, 2016

(65) Prior Publication Data

US 2017/0037709 A1 Feb. 9, 2017

Related U.S. Application Data

(62) Division of application No. 13/890,903, filed on May 9, 2013, now Pat. No. 9,476,286.

(30) Foreign Application Priority Data

May 21, 2012 (WO) ..... PCT/US2012/038767

(51) Int. Cl.

| | |
|---|---|
| ***E21B 41/02*** | (2006.01) |
| ***E21B 43/04*** | (2006.01) |
| ***E21B 41/00*** | (2006.01) |

(52) U.S. Cl.

CPC ..... *E21B 41/02* (2013.01); *E21B 41/0078* (2013.01); *E21B 43/04* (2013.01); *E21B 43/045* (2013.01)

(58) Field of Classification Search

CPC ..... E21B 47/01; E21B 47/10; E21B 47/12; E21B 41/0078; E21B 41/02; E21B 43/045; E21B 43/04

See application file for complete search history.

(56) References Cited

U.S. PATENT DOCUMENTS

| | | | |
|---|---|---|---|
| 4,540,055 | A | 9/1985 | Drummond |
| 5,505,262 | A | 4/1996 | Cobb |

(Continued)

OTHER PUBLICATIONS

International Search Report with Written Opinion dated Feb. 26, 2013 for PCT Patent Application No. PCT/US2012/038767, 9 pages.

(Continued)

*Primary Examiner* — Robert E Fuller
*Assistant Examiner* — Christopher J Sebesta
(74) *Attorney, Agent, or Firm* — Locke Lord LLP; Joshua L. Jones

(57) ABSTRACT

A system for use with a subterranean well can include a tubular string with a fluid discharge apparatus, the fluid discharge apparatus including a curved flow path which directs a fluid to flow less toward a structure external to the tubular string. A fluid discharge apparatus can include a generally tubular housing having a longitudinal axis, and at least one curved flow path which directs fluid to flow more parallel to the longitudinal axis from an interior of the housing to an exterior of the housing. A method of mitigating erosion of a structure external to a discharge port in a well can include directing a fluid to flow through a curved flow path, thereby reducing impingement of the fluid on the structure in the well.

6 Claims, 5 Drawing Sheets

(56) References Cited

U.S. PATENT DOCUMENTS

| | | | | |
|---|---|---|---|---|
| 5,636,691 | A | 6/1997 | Hendrickson | |
| 6,491,097 | B1 | 12/2002 | Oneal | |
| 7,559,357 | B2 | 7/2009 | Clem | |
| 7,802,640 | B2 | 9/2010 | Gutmark et al. | |
| 8,047,308 | B2 | 11/2011 | Gutmark et al. | |
| 8,322,418 | B2 * | 12/2012 | Martinez | E21B 17/1085 166/222 |
| 2003/0000700 | A1 | 1/2003 | Hailey, Jr. | |
| 2006/0191685 | A1 * | 8/2006 | Coronado | E21B 43/045 166/278 |
| 2006/0213671 | A1 | 9/2006 | Li | |
| 2007/0000700 | A1 | 1/2007 | Switzer | |
| 2007/0163811 | A1 | 7/2007 | Gutmark et al. | |
| 2007/0246226 | A1 * | 10/2007 | Macias | E21B 43/04 166/386 |
| 2008/0314588 | A1 * | 12/2008 | Langlais | E21B 41/0078 166/278 |
| 2009/0152013 | A1 | 6/2009 | Buske | |
| 2011/0132603 | A1 | 6/2011 | Martinez et al. | |
| 2011/0266374 | A1 * | 11/2011 | Hammer | E21B 17/1085 239/589 |
| 2012/0031611 | A1 * | 2/2012 | Xu | E21B 17/1085 166/271 |

OTHER PUBLICATIONS

Baker Hughes; "SC-XP Extreme Performance System", Overview, 30129, dated 2011, 1 page.

Halliburton; "Multi-Position Gravel Pack System", H06327, dated May 2008, 2 pages.

Halliburton; "Closing Sleeve 4.75 MCS Square Ports High Opening Force", Drawing No. 12MCS333, dated Jan. 23, 2008, 1 page.

IPO of Singapore Search Report and Written Opinion for Application No. 11201406005Y dated May 19, 2015.

* cited by examiner

EROSION REDUCTION IN SUBTERRANEAN WELLS

CROSS-REFERENCE TO RELATED APPLICATION

This application is a divisional application of U.S. patent application Ser. No. 13/890,903 filed May 9, 2013, the disclosures of which are incorporated by reference herein in their entireties.

This application claims the benefit under 35 USC § 119 of the filing date of International Application Serial No. PCT/US12/38767 filed 21 May 2012. The entire disclosure of this prior application is incorporated herein by this reference.

BACKGROUND

This disclosure relates generally to equipment utilized and operations performed in conjunction with a subterranean well and, in one example described below, more particularly provides for reducing erosion due to fluid discharge in wells.

Fluids are sometimes discharged into casing which lines a wellbore. For example, in gravel packing, fracturing, stimulation, conformance and other types of operations, fluids are discharged from a tubular string in the wellbore. At least in gravel packing and fracturing operations, the fluid can be flowed with abrasive particles (e.g., sand, proppant, etc.) therein, and the resulting abrasive slurry can increase erosion of well structures.

Accordingly, it will be appreciated that improvements are continually needed in the art of reducing erosion of casing and other structures in wells.

SUMMARY

In this disclosure, systems, apparatus and methods are provided which bring improvements to the art of mitigating erosion in wells. One example is described below in which fluid is discharged from a tubular string in a manner which reduces erosion of a structure external to the tubular string.

A system for use with a subterranean well is described below. In one example, the system can comprise a tubular string including a fluid discharge apparatus, the fluid discharge apparatus including a curved flow path which directs a fluid to flow less toward a structure external to the tubular string.

Also described below is a fluid discharge apparatus which can include a generally tubular housing having a longitudinal axis. At least one curved flow path of the apparatus directs fluid to flow more parallel to the longitudinal axis from an interior of the housing to an exterior of the housing.

A method of mitigating erosion of a structure external to a fluid discharge apparatus in a well is provided to the art by this disclosure. In one example, the method can comprise directing a fluid to flow through a curved flow path, thereby reducing impingement of the fluid on the structure in the well.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
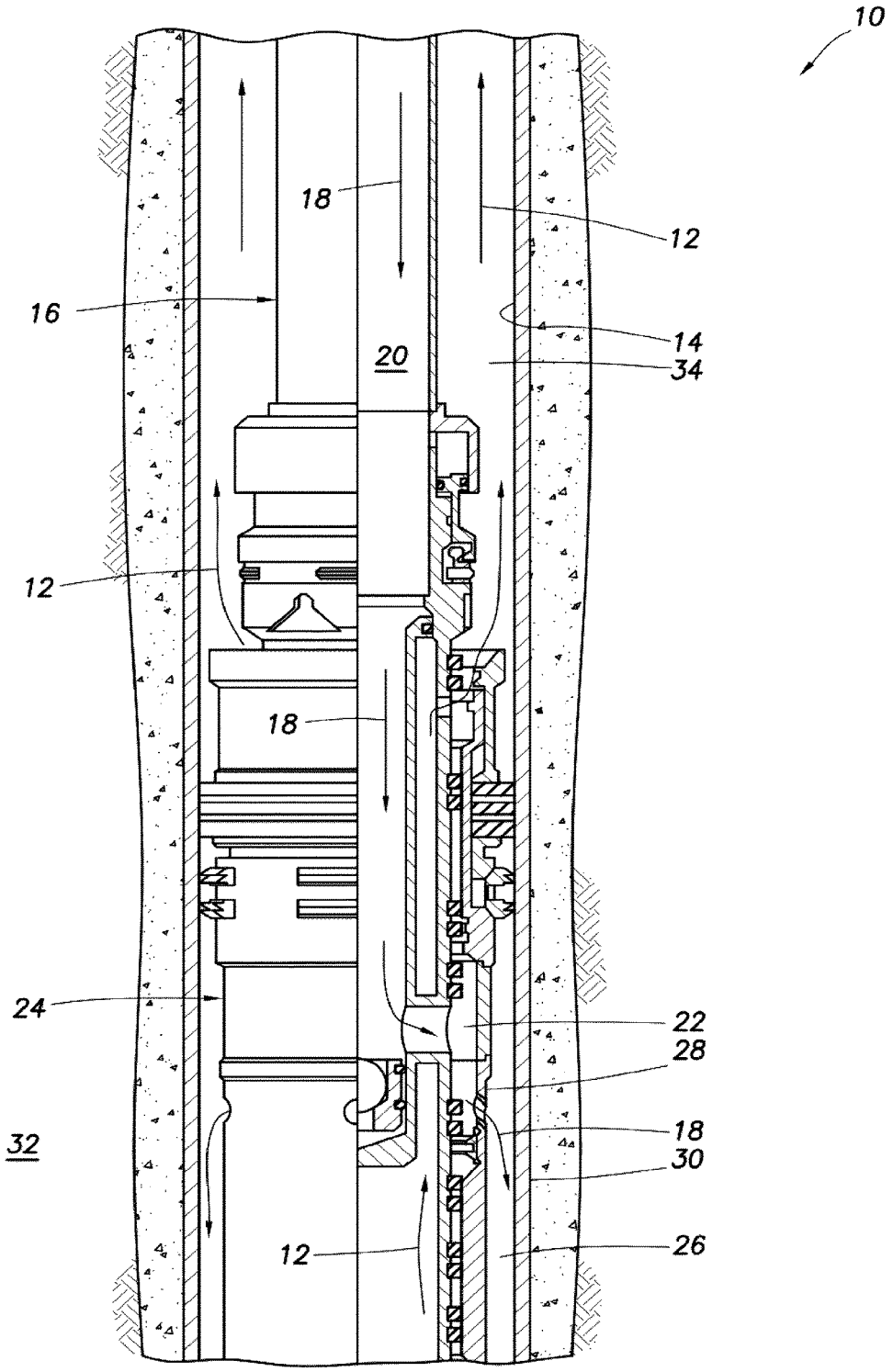
FIG. 1 is a representative partially cross-sectional view of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10, a fluid 12 is flowed into a wellbore 14 via a tubular string 16 (such as, a work string, a production tubing string, etc.). In this example, the fluid 12 is initially part of an abrasive slurry 18 (e.g., the fluid is mixed with abrasive particles, such as, sand, proppant, etc.) flowed through an interior longitudinal flow passage 20 of the tubular string 16.

The slurry 18 flows outward from the tubular string 16, into a longitudinal flow passage 22 of an outer tubular string 24, and outward from the flow passage 22 to an annulus 26 formed radially between the tubular string 24 and the wellbore 14. A fluid discharge apparatus 28 is used to discharge the slurry 18 from the passage 22 to the annulus 26.

In examples described more fully below, the apparatus 28 can be constructed so that the slurry 28 is directed to flow more longitudinally through the annulus 26 as it exits the apparatus. In this manner, erosion of a structure 30 external to the apparatus 28 can be mitigated.

In the example depicted in FIG. 1, the structure 30 comprises a casing or liner which forms a protective lining for the wellbore 14. In other examples, the structure 30 could comprise another type of structure (e.g., production tubing, an adjacent control line or cable, etc.). The structure 30 in some examples could be a wall of the wellbore 14 (if it is uncased), or a protective shroud in a cased or uncased wellbore.

After entering the annulus 26, the slurry 18 flows about the tubular string 24 and optionally into an earth formation 32 penetrated by the wellbore 14. The abrasive particles can be filtered from the slurry 18 by well screens (not shown) connected in the tubular string 24, and the filtered fluid 12 can then flow back through the tubular string 16 to an annulus 34 formed radially between the wellbore 14 and the tubular string 16.

It is not necessary for the fluid 12 to be mixed with abrasive particles prior to being flowed into the wellbore 14. In other examples, the fluid 12 could be flowed into the wellbore 14 without the abrasive particles, and the fluid can be discharged into the wellbore 14 without the abrasive particles.

It is not necessary for the fluid 12 to be flowed back through the annulus 34. In other examples, the fluid 12 could be flowed into the wellbore 14, without being flowed back to the surface.

It is not necessary for the wellbore 14 to be vertical, or for the tubular strings 16, 24 to be configured as depicted in FIG. 1 and described herein. Thus, the scope of this disclosure is not limited in any way to the details of the system 10 and method of FIG. 1.

Figure 2:
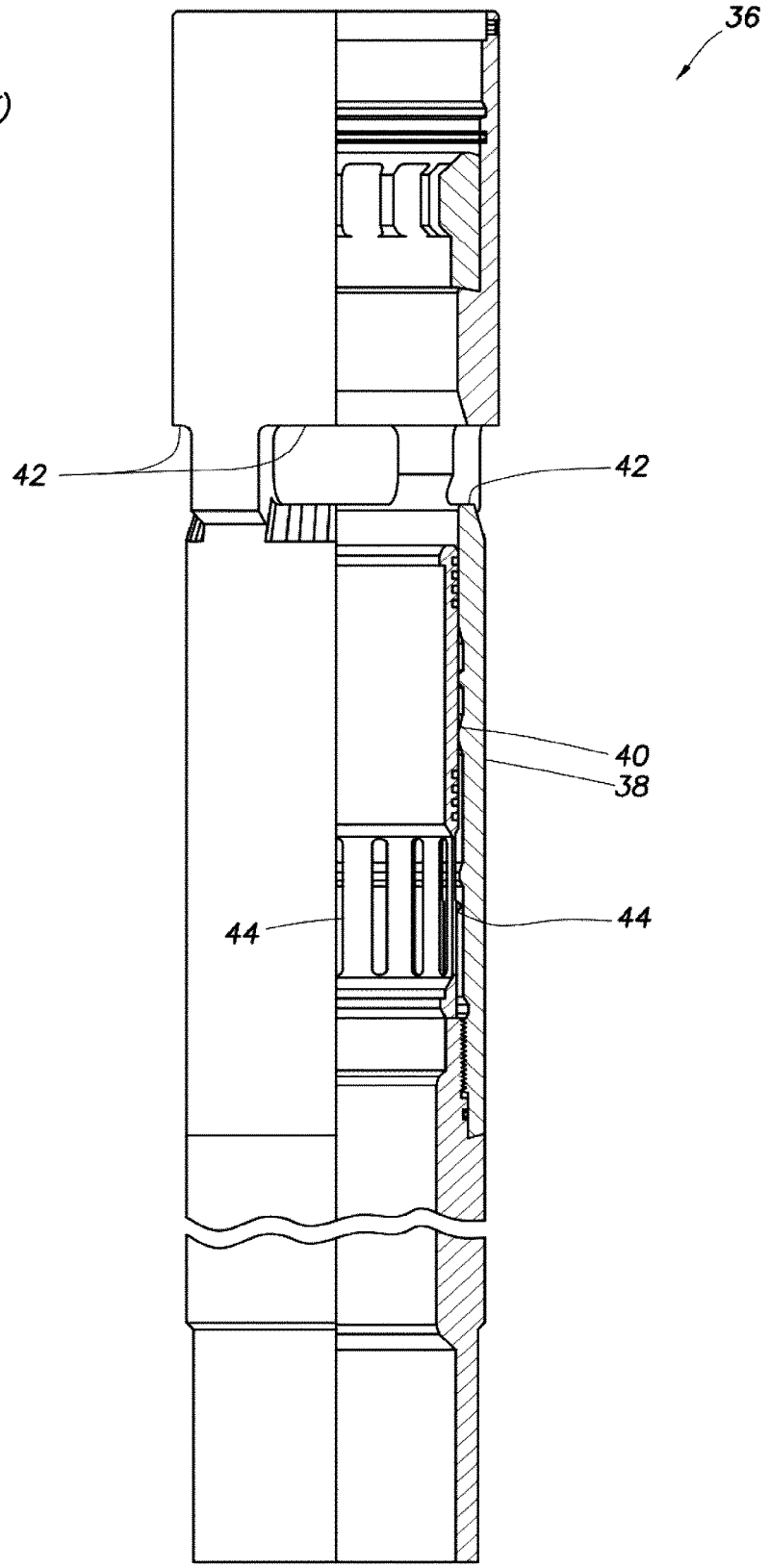
FIG.2 (PRIOR ART)
FIG. 2 is a cross-sectional view of a prior art closing sleeve.

Referring additionally now to FIG. 2, a cross-sectional view of a prior art apparatus of the type known to those skilled in the art as a closing sleeve 36 is illustrated. In the past, the closing sleeve 36 could have been used for the apparatus 28.

The closing sleeve 36 includes an outer housing 38 and an inner sleeve 40 reciprocably received in the housing. In a closed configuration, the sleeve 40 blocks flow through ports 42 in the housing 38. In an open configuration (depicted in FIG. 2), the sleeve 40 does not block flow through the ports 42.

Resilient collets 44 formed on the sleeve 36 releasably retain the sleeve in its open and closed positions. The sleeve 36 can be shifted between its open and closed positions by displacement of a work string through the sleeve 40.

Figure 3:
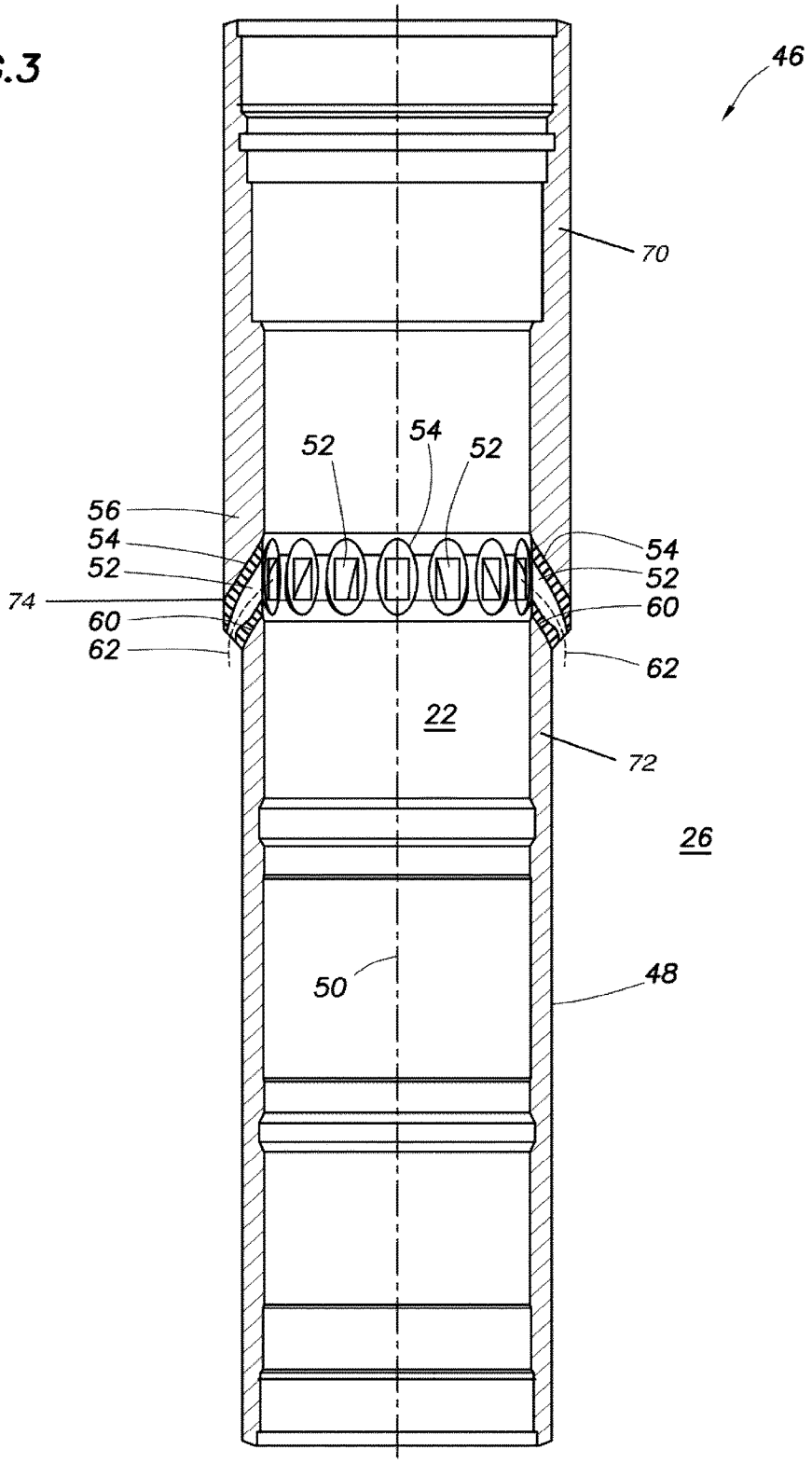
FIG. 3 is a representative cross-sectional view of a fluid discharge apparatus which may be used in the system and method of FIG. 1, and which can embody principles of this disclosure.

Referring additionally now to FIG. 3, a cross-sectional view of a flow discharge apparatus 46 which may be used for the apparatus 28 in the system 10 and method of FIG. 1 is representatively illustrated. The apparatus 46 may also be used in other systems and methods in keeping with the scope of this disclosure.

The apparatus 46 includes a generally tubular housing 48 with a longitudinal axis 50. When used in the system 10, the housing 48 would be interconnected in the tubular string 24, with the passage 22 internal to the housing, and the annulus 26 external to the housing.

A sliding sleeve or other closure member(s) (such as the sleeve 40 of FIG. 2) can be used in the housing 48 to selectively block multiple curved flow paths 52 which provide fluid communication between an interior and an exterior of the housing. In the FIG. 3 example, the curved flow paths 52 are formed in separate inserts 54 secured in a side wall 56 of the housing 48.

In other examples, the curved flow paths 52 could be formed directly in the housing side wall 56, a single insert 54 could contain multiple flow paths, a single flow path could be used, etc. Thus, the scope of this disclosure is not limited in any manner to the details of the example depicted in FIG. 3 or described herein.

The curved flow paths 52 alter a direction of flow of the fluid 12, so that the fluid flows more longitudinally when it exits the flow paths. In the FIG. 3 example, the fluid 12 would flow radially outward and longitudinally as it enters the flow paths 52, but the flow paths divert the fluid 12 so that it flows less radially and more longitudinally as it exits the flow paths.

In this manner, the fluid 12 will impinge less on the structure 30 when it exits the apparatus 46. This will result in less erosion of the structure 30. The reduced erosion will be especially enhanced if the fluid 12 is mixed with the abrasive particles to form the slurry 18 which flows outward from the apparatus 46. If the fluid 12 is mixed with proppant, the reduced impingement of the fluid on the structure 30 can also result in less damage to the proppant.

Note that it is not necessary for the flow paths 52 to divert the fluid 12 so that it flows only longitudinally external to the housing 48, or in the annulus 26. The flow could in some examples be directed both longitudinally and circumferentially (e.g., helically) through the annulus 26.

In other examples, each flow path 52 could direct the fluid 12 to impinge on flow from another flow path, so that kinetic energy of the flows is more rapidly dissipated, etc. In still further examples, the flow paths 52 could curve in opposite directions (e.g., with some of the flow paths curving upward and some of the flow paths curving downward as viewed in FIG. 3), to thereby provide for more effective flow area for discharge of the fluid 12 into the annulus 26.

Although in FIG. 3 the flow paths 52 are depicted as being evenly circumferentially distributed about the housing side wall 56, in other examples the flow paths could be distributed axially, or in any other direction or combination of directions, and the flow paths could be unevenly distributed, or oriented in one or more particular directions, etc.

Figure 4:
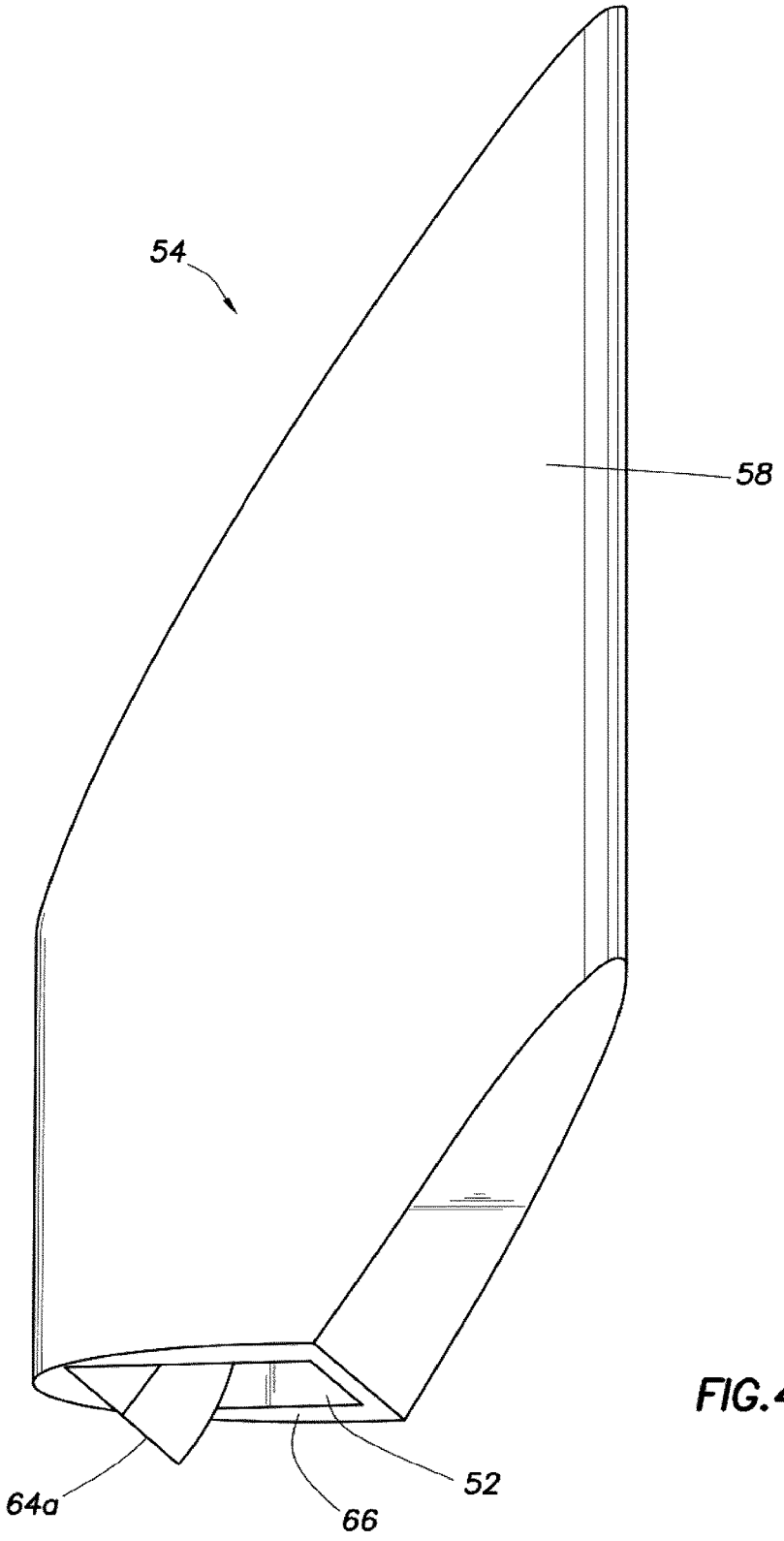
FIG. 4 is a representative oblique exterior view of an insert for a housing of the apparatus.

Referring additionally now to FIG. 4, an enlarged scale external view of one of the inserts 54 is representatively illustrated. In this view it may be seen that the insert 54 has a cylindrical outer surface 58 dimensioned for being received securely in openings 60 formed through the housing side wall 56.

The inserts 54 can be secured in the housing 48 using any technique, such as, welding, brazing, soldering, shrink-fitting, press-fitting, bonding, fastening, threading, etc. The inserts 54 can be made of an erosion resistant material, such as, tungsten carbide, hardened steel, ceramic, etc.

Figure 5:
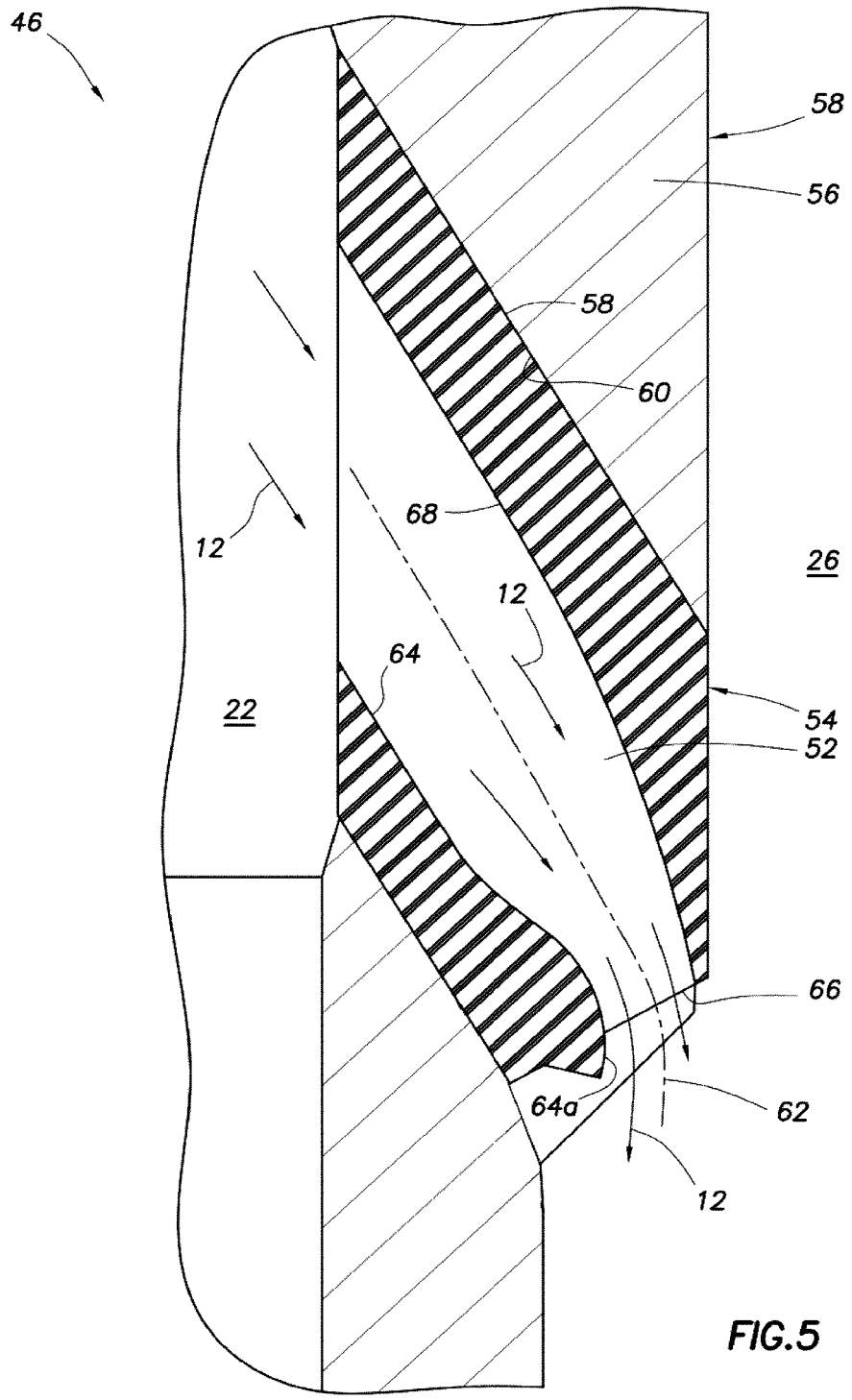
FIG. 5 is a representative enlarged scale cross-sectional view of the insert in the housing.

Referring additionally now to FIG. 5, a cross-sectional view of the insert 54 as installed in the housing 48 is representatively illustrated. In this view it may be more clearly seen that the flow path 52 has a curved central axis 62, and that a flow area of the flow path decreases in a direction of flow of the fluid 12.

The reduction in flow area is primarily due in this example to the shape of a curved surface 64 bounding the flow path 52. Just upstream of an outlet 66 of the flow path 52, the surface 64 curves inward, thereby reducing the flow area.

This reduced flow area causes an increase in flow velocity as the fluid 12 exits the outlet 66. The increased velocity enhances a fluid dynamics effect known as the Coanda effect, whereby a fluid tends to flow along a surface bounding its flow.

The surface 64 near the outlet 66 also curves increasingly in the longitudinal direction, so that the fluid 12 will be induced to flow more in the longitudinal direction when it exits the housing 58. Another curved surface 68 (which also curves increasingly toward the longitudinal direction in the direction of flow of the fluid 12) may be provided opposite the surface 64. Alternatively, the surfaces 64, 68 could be portions of a continuous surface which encloses the flow path 52.

A portion **64*a* of the surface 64 can extend outward past the outlet 66. This extended portion 64*a* can enhance the diversion of the fluid 12 to more longitudinal flow in the annulus 26, due to the above-mentioned Coanda effect. Indeed, the portion 64*a* can even curve back toward the housing 58 somewhat, so that the fluid 12 flows toward and along an outer surface of the housing. This can further mitigate erosion of any structure external to the housing 58**.

It may now be fully appreciated that the above disclosure provides significant advancements to the art of mitigating erosion due to discharge of fluid into a wellbore. In the system 10 example above, the curved flow paths 52 direct the fluid 12 to flow more longitudinally through the annulus 26, so that a structure 30 which surrounds the tubular string 24 is protected from erosion. This result is achieved conveniently and economically, without a need to enclose the housing 58 in an outer erosion-resistant shroud, which would take up valuable space in the wellbore 14. However, an outer shroud could be used, if desired.

The above disclosure provides to the art a method of mitigating erosion of a structure 30 external to a fluid discharge apparatus 46 in a wellbore 14. In one example, the method can comprise directing a fluid 12 to flow through a curved flow path 52, thereby reducing impingement of the fluid 12 on the structure 30 in the well.

The curved flow path 52 may be interconnected in a tubular string 24, and may induce the fluid 12 to flow longitudinally through an annulus 26 formed between the tubular string 24 and the structure 30. The curved flow path 52 may induce the fluid 12 to flow helically through the annulus 26.

The method can include mixing abrasive particles with the fluid 12 prior to the directing step.

The structure 30 may comprise a protective lining for a wellbore 14, a wall of the wellbore, and/or a protective shroud in the wellbore.

A flow area of the flow path 52 can change along a length of the flow path 52. The flow area may decrease in a direction of flow through the flow path 52.

The flow path 52 can comprise a curved surface 64 which is increasingly longitudinally oriented in a direction of flow through the flow path 52. The surface 64 may extend outward from an outlet 66 of the flow path 52. The Coanda effect can induce fluid to flow along the surface 64*a* which extends outward from the outlet 66.

The curved flow path 52 may be incorporated as part of a tubular string 24, and the flow path 52 may comprise a curved surface 64 which induces the fluid 12 to flow through an annulus 26 formed between the tubular string 24 and the structure 30.

A fluid discharge apparatus 46 for use in a subterranean well is also described above. In one example, the apparatus 46 can comprise a generally tubular housing 48 having a longitudinal axis 50, and at least one curved flow path 52 which directs fluid 12 to flow more parallel to the longitudinal axis 50 from an interior of the housing 48 to an exterior of the housing 48.

A system 10 for use with a subterranean well is provided to the art by this disclosure. In an example described above, the system 10 can include a tubular string 24 with a fluid discharge apparatus 46, the fluid discharge apparatus 46 including a curved flow path 52 which directs a fluid 12 to flow less toward a structure 30 external to the tubular string 24.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising: a tubular string including a fluid discharge apparatus, the fluid discharge apparatus including a curved flow path which directs a fluid to flow substantially parallel to a longitudinal axis of the tubular string wherein the curved flow path includes a curved surface that extends convexly outward as it passes an outlet beyond where the flow path is enclosed.

2. The system of claim 1, wherein the curved flow path induces the fluid to flow longitudinally through an annulus formed between the tubular string and a protective shroud.

3. The system of claim 1, wherein abrasive particles are mixed with the fluid.

4. The system of claim 1, wherein a flow area of the flow path changes along a length of the flow path.

5. The system of claim 1, wherein the curved surface is increasingly longitudinally oriented in a direction of flow through the flow path.

6. The system of claim 1, wherein the curved surface induces the fluid to flow through an annulus formed between the tubular string and a protective shroud.

* * * * *